United States Patent [19]

Struthers et al.

[11] Patent Number: 4,984,931

[45] Date of Patent: Jan. 15, 1991

[54] CONTROL KNOB AND ADAPTOR ASSEMBLY

[75] Inventors: Scott Struthers, San Clemente; Jerry Curtis, Buena Park; Jack Reed, Lake Elsinore, all of Calif.

[73] Assignee: Dana Innovations, San Clemente, Calif.

[21] Appl. No.: 456,496

[22] Filed: Dec. 26, 1989

[51] Int. Cl.[5] ..... B25G 3/02

[52] U.S. Cl. ..... 403/362; 403/365; 403/356

[58] Field of Search ..... 403/362, 365, 366, 356; 292/350

[56] References Cited

U.S. PATENT DOCUMENTS

| | | | |
|---|---|---|---|
| 2,191,304 | 2/1940 | Ashendorf | 403/365 X |
| 2,306,876 | 12/1942 | Gits | 292/350 X |
| 3,206,236 | 9/1965 | Darling | 403/356 |
| 3,708,243 | 1/1973 | Wooden | 403/362 X |

*Primary Examiner*—Andrew V. Kundrat

*Attorney, Agent, or Firm*—Stetina and Brunda

[57] ABSTRACT

A control knob and adaptor assembly, for providing axial position adjustment of a knob relative to a switch shaft having an adaptor with a collar that has a central opening formed therein to receive the switch shaft. The adaptor is disposable at varying positions along the shaft length. A set screw is extendable through the collar for securing the collar to the switch shaft. The collar has an outer surface formed to engage a central aperture formed on the inner surface of the knob.

1 Claim, 1 Drawing Sheet

CONTROL KNOB AND ADAPTOR ASSEMBLY

FIELD OF THE INVENTION

The present invention relates generally to knobs for rotating the shafts of switches and the like and more particularly to a control knob and adaptor assembly having an adaptor that has a collar with a central opening formed therein to receive a switch shaft such that the adaptor is disposable at varying positions along the switch shaft. A set screw, disposable within the collar, secures the collar to the switch shaft. The outer surface of the collar is formed to engage a central opening formed on the inner surface of the knob.

BACKGROUND OF THE INVENTION

Knobs are well known for rotating the shafts of switches and the like. Such knobs generally mount to the shafts of switches in one of two manners. The knob can simply slide over the shaft and be held in position by a key formed in the knob which engages a keyway formed in the shaft. Alternatively a set screw on the knob can be used to secure the knob the shaft.

When a keyed knob is used on a shaft which is formed to receive the keyed knob, the knob is pushed completely onto the shaft and no provision is made for axial positioning of the knob on the shaft. Axial adjustment of the knob along the length of the switch shaft is desirable so that the knob can be used with shafts of varying lengths and with various thicknesses of faceplates which are used to cover switch assemblies.

When a knob having a set screw is attached to a shaft, the knob can be positioned axially along the length of the shaft prior to tightening the set screw, which secures the knob to the shaft. Therefore, knobs secured with set screws may be axially positioned upon the shaft. When a knob with a set screw is used the set screw must be accessible through the knob so that it can be tightened to secure the knob to the shaft and loosened to remove the knob from the shaft. The set screw is disposed in a threaded aperture in the knob. This aperture extends from the outer periphery of the knob through the knob to the inner opening of the knob into which the shaft is received. Therefore, the aperture and set screw are visible on the periphery of the knob. That is, the set screw and the aperture can be seen by the user when using the knob to rotate the shaft of the switch. Visibility of the set screw and aperture on the periphery of the knob detracts from the aesthetic appeal of the knob. Knobs intended for use in fashionable home and commercial settings are intended to be aesthetically pleasing as well as functional. Therefore, the visibility of any mounting hardware is to be minimized.

Fashionable knobs, having no set screw or threaded aperture, are commonly used in the prior art. This is accomplished by using knobs of the keyed central opening type. However, such knobs are not axially positionable and cannot be used in all applications. Therefore, when a knob must be used that is axially positionable, then a knob must be chosen which has a visible set screw and threaded aperture.

As such the prior art has recognized the problem of providing knobs having a pleasing appearance and also the problem of providing knobs which are axially positionable upon the shaft of a switch. However, the proposed solutions have to date been ineffective in providing a satisfactory remedy.

SUMMARY OF THE INVENTION

The present invention is a control knob and adaptor assembly for providing axial positioning adjustment of a knob relative to a switch shaft. The present invention comprises an adaptor having a collar with a central opening formed therein to receive the switch shaft and a set screw which extends through the collar for securing the collar to the switch shaft. The collar has an outer surface formed to engage a central aperture formed on the inner surface of the knob.

Therefore the present invention provides a fashionable knob wherein the set screw and threaded aperture are not visible to the user and which is axially positionable upon the shaft of a switch. These as well as other future advantages will be more apparent from the following description and drawing. It is understood that changes in the specific structure shown and described may be made within the scope of the claims without departing from the spirit of the invention.

DETAILED DESCRIPTION OF A PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood however, that the same or equivalent functions and sequences may be accomplished by different embodiments that are also intended to be encompassed by the spirit and scope of the invention.

Figure 1:
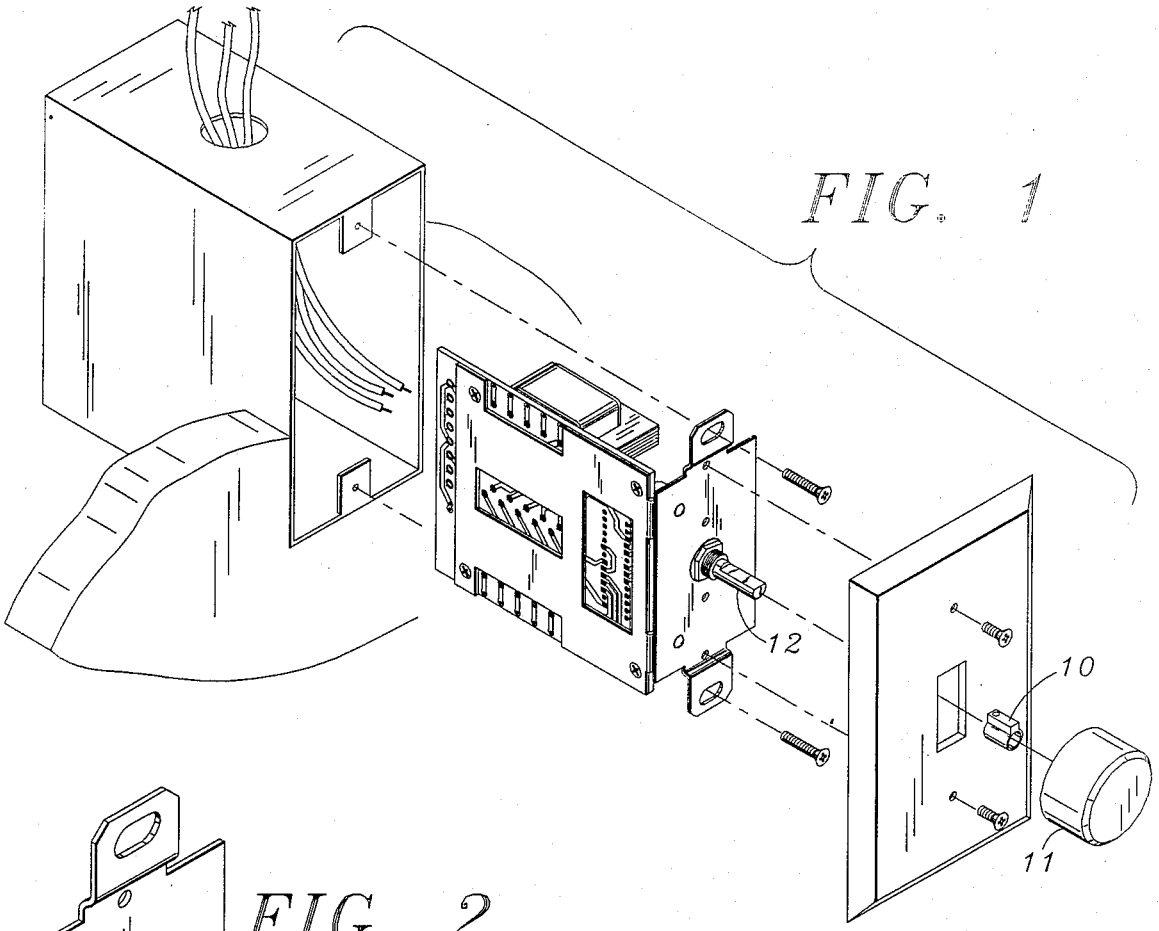
FIG. 1 is an exploded perspective view of a switch showing the control knob and adaptor assembly of the present invention.
Figure 2:
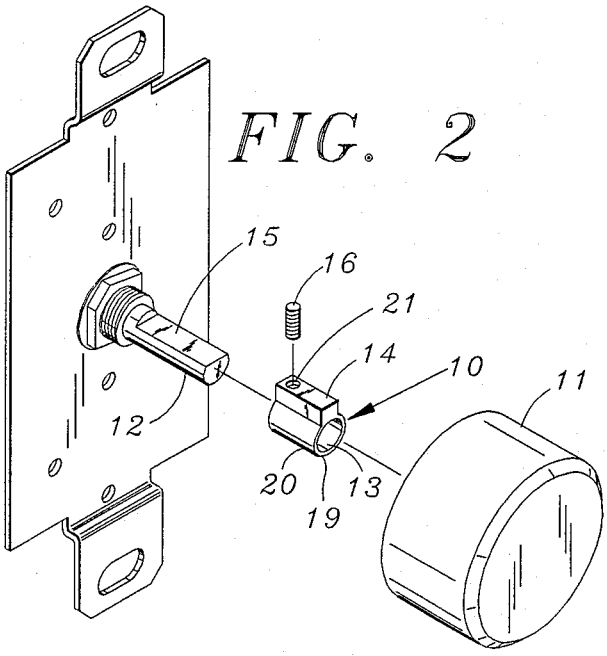
FIG. 2 is an enlarged exploded perspective view showing the control knob and adaptor assembly of the present invention.
Figure 3:
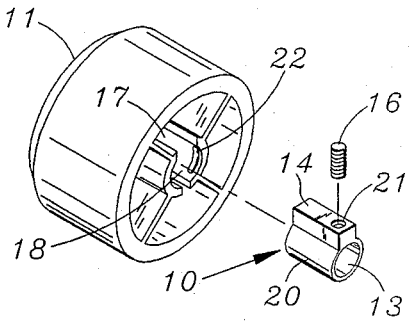
FIG. 3 is a perspective view showing the central opening and the keyway of the knob.

The control knob and adaptor assembly of the present invention is illustrated in FIGS. 1–3 which depict a preferred embodiment of the invention.

Referring to FIG. 1, a knob 11 is used to rotate a switch shaft 12. An adaptor 10 adapts the knob 11 to the switch shaft 12. The use of the adaptor 10 permits the axial positioning adjustment of the knob 11 on the switch shaft 12.

As best shown in FIG. 2, the adaptor 10 has a collar 19, and a central opening 13 which is formed to receive the switch shaft 12. The collar is disposable at varying positions along the shaft length. A set screw 16 is extendable through the collar 19 for securing the collar to the switch shaft 12. The collar has an outer surface 20 formed to engage a central opening 18 in the knob 11, best shown in FIG. 3. The knob 11 has a central opening 18 formed to engage the outer surface 20 of the collar 19. A key 14 formed on the outer surface 20 of the adaptor 10 is formed to engage a keyway 17 in the central opening 18 of the knob 11. The key 14 of the adaptor 10 and the keyway 17 of the knob 11 cooperate to provide locking engagement of the knob 11 to the adaptor 10 so that when the knob 11 is rotated, the knob 11 thereby causes the adaptor 14 and the switch shaft 12 to rotate.

The adaptor 10 is preferably die cast zinc and the knob 11 is preferably injection molded plastic. However, one of normal skill in the art will recognize that other materials and manufacturing processes may be used.

The axial position of the knob 11 can be varied along the length of the shaft 12 by placing the adaptor 10 on the shaft 12 such that when the knob 11 is installed on the adaptor 10 the axial position of the knob 11 will be as desired. This is accomplished by sliding the adaptor 10 onto the shaft 12 to the desired axial position and then tightening the set screw 16 to provide a locking engagement of the adaptor 10 to the shaft 12. Next the knob 11 is slid onto the adaptor 10 with the keyway 17 in the knob 11 aligned with the key 14 on the adaptor 10. A detent 22 secures the knob 11 on the adaptor 10 once the knob 11 is in place upon the adaptor 10. The detent 22 is a raised lip which snaps into place behind the adapter 10 after the adapter 10 has been completely received within the central opening 19 in the knob 11.

The present invention thereby provides a knob lacking a visible set screw and threaded aperture for improved aesthetic appeal and which is also capable of providing axial positioning adjustment.

It is understood that the exemplary control knob and adaptor assembly described herein and shown in the drawings represents only a presently preferred embodiment of the invention. Indeed, various modifications and additions may be made to such embodiment without departing from the spirit and scope of the invention. For example, the shape and size of the key 14 and the keyway 17 may be varied while still providing locking engagement of the adaptor 10 to the knob 11. Also, other arrangements of the set screw 16 within the adaptor 10 are contemplated. Thus, these and other modifications and additions may be obvious to those skilled in the art and may be implemented to adapt the present invention for use in a variety of different applications.

What is claimed is:

1. A control knob adaptor assembly for providing axial position adjustment of a know relative to the length of a switch shaft comprising:

(a) a collar having a central opening formed therein to receive the switch shaft, said collar being disposable at varying positions along the shaft length and having a key formed in the outer surface thereof to engage a central opening formed on an inner surface of the knob;

(b) a knob having a central opening formed therein, the central opening having a keyway formed therein, said keyway being formed to receive the key formed on the collar outer surface, said knob further having a detent within the knob central opening, said detent providing snap engagment of said knob to said collar when said collar is fully received within said knob; and (c) a set screw extendable through said collar for securing said collar in place along the length of the switch shaft.

* * * * *

UNITED STATES PATENT AND TRADEMARK OFFICE

CERTIFICATE OF CORRECTION

PATENT NO. : 4,984,931

DATED : January 15, 1991

INVENTOR(S) : Struthers, et al

It is certified that error appears in the above-identified patent and that said Letters Patent is hereby corrected as shown below:

Column 4, line 13, delete "a" and insert therefore --the--.

Signed and Sealed this

Twenty-sixth Day of May, 1992

*Attest:*

DOUGLAS B. COMER

*Attesting Officer*

*Acting Commissioner of Patents and Trademarks*